US012065778B2

(12) United States Patent
Boucké

(10) Patent No.: US 12,065,778 B2
(45) Date of Patent: Aug. 20, 2024

(54) TILE, IN PARTICULAR CARPET TILE, AND COVERING OF SUCH TILES

(71) Applicant: I4F Licensing NV, Turnhout (BE)

(72) Inventor: Eddy Alberic Boucké, Menen (BE)

(73) Assignee: i4F Licensing NV, Turnhout (BE)

( * ) Notice: Subject to any disclaimer, the term of this patent is extended or adjusted under 35 U.S.C. 154(b) by 1049 days.

(21) Appl. No.: 16/960,596

(22) PCT Filed: Jan. 9, 2019

(86) PCT No.: PCT/EP2019/050461
§ 371 (c)(1),
(2) Date: Jul. 8, 2020

(87) PCT Pub. No.: WO2019/137966
PCT Pub. Date: Jul. 18, 2019

(65) Prior Publication Data

US 2020/0332460 A1 Oct. 22, 2020

(30) Foreign Application Priority Data

Jan. 9, 2018 (NL) ..... 2020254

(51) Int. Cl.
*D06N 7/00* (2006.01)
*D06N 3/00* (2006.01)
(Continued)

(52) U.S. Cl.
CPC ..... *D06N 7/0086* (2013.01); *D06N 3/0043* (2013.01); *D06N 7/0071* (2013.01); *E04F 13/0866* (2013.01); *E04F 13/088* (2013.01); *E04F 13/16* (2013.01); *E04F 15/02038* (2013.01); *E04F 15/02133* (2013.01); *E04F 15/102* (2013.01); *E04F 15/105* (2013.01);
(Continued)

(58) Field of Classification Search
CPC ..... D06N 7/0086; D06N 7/0071; D06N 2205/04; D06N 2209/106; D06N 2209/1664; D06N 2211/066; D06N 3/0043; E04F 13/088; E04F 15/02133; E04F 15/107; Y10T 428/23979
See application file for complete search history.

(56) References Cited

U.S. PATENT DOCUMENTS 4,286,003 A 8/1981 Higgins et al.
8,024,904 B2 9/2011 Hannig
(Continued)

FOREIGN PATENT DOCUMENTS

CN 106164393 A 11/2016
DE 102011002188 A1 10/2011
(Continued)

OTHER PUBLICATIONS

WO 2011/131708 A1 translation, Espacenet, 2011.*

*Primary Examiner* — Cheryl Juska
(74) *Attorney, Agent, or Firm* — The Webb Law Firm

(57) ABSTRACT

The invention relates to a tile, in particular a carpet tile. The invention also relates to the use a tile according to the invention as floor tile, wall tile, or ceiling tile. The invention further relates to a tile covering consisting of a plurality of
(Continued)

tiles according to the invention. The invention additionally relates to a carpet covering consisting of at least one carpet tile according to the invention.

26 Claims, 3 Drawing Sheets

(51) Int. Cl.

| | |
|---|---|
| ***D06N 7/02*** | (2006.01) |
| ***E04F 13/08*** | (2006.01) |
| ***E04F 13/16*** | (2006.01) |
| ***E04F 15/02*** | (2006.01) |
| ***E04F 15/10*** | (2006.01) |

(52) U.S. Cl.
CPC ..... *E04F 15/107* (2013.01); *D06N 2205/04* (2013.01); *D06N 2209/025* (2013.01); *D06N 2209/106* (2013.01); *D06N 2209/1664* (2013.01); *D06N 2211/066* (2013.01); *E04F 2201/0138* (2013.01); *E04F 2201/0153* (2013.01); *Y10T 428/23979* (2015.04)

(56) References Cited

U.S. PATENT DOCUMENTS

| | | | | |
|---|---|---|---|---|
| 9,874,028 | B2 | 1/2018 | Boucké et al. | |
| 2003/0203152 | A1 | 10/2003 | Higgins et al. | |
| 2016/0194885 | A1* | 7/2016 | Whispell ..... | E04F 15/02005 52/309.4 |

FOREIGN PATENT DOCUMENTS

| | | | | |
|---|---|---|---|---|
| EP | 1415056 | | 5/2004 | |
| JP | S51102325 | | 9/1976 | |
| JP | S58167157 | U | 11/1983 | |
| JP | H4174163 | A | 6/1992 | |
| JP | 3018810 | U | 11/1995 | |
| JP | 2004257066 | A | 9/2004 | |
| JP | 2006507429 | A | 3/2006 | |
| JP | 2017511851 | A | 4/2017 | |
| WO | 03016654 | A1 | 2/2003 | |
| WO | 03087458 | A1 | 10/2003 | |
| WO | WO-2011131708 | A1 * | 10/2011 | ..... D06N 7/0073 |

* cited by examiner

TILE, IN PARTICULAR CARPET TILE, AND COVERING OF SUCH TILES

CROSS-REFERENCE TO RELATED APPLICATIONS

This application is the United States national phase of International Application No. PCT/EP2019/050461 filed Jan. 9, 2019, and claims priority to The Netherlands Patent Application No. 2020254 filed Jan. 9, 2018, the disclosures of which are hereby incorporated by reference in their entirety.

BACKGROUND OF THE INVENTION

Field of the Invention

The invention relates to a tile, in particular a carpet tile. The invention also relates to the use a tile according to the invention as floor tile, wall tile, or ceiling tile. The invention further relates to a tile covering consisting of a plurality of tiles according to the invention. The invention additionally relates to a carpet covering consisting of at least one carpet tile according to the invention.

Description of Related Art

Historically, carpet tiles were mostly used in areas that face high traffics due to its high flexibility and usability, but now-a-days it is considered to be the height of fashion and practicality as it resembles the qualities in a carpet. Carpet tiles can suit the requirement of any flooring for both residential and commercial areas in high traffic areas. Carpet tiles come in variety of sizes and styles and are great for covering tricky shaped floor spaces. Though it offers handful of advantages it has its own drawbacks. Carpet tiles are available in different textures and with different base materials. Poor quality tiles usually have rubber base backing. While you purchase one with rubber base, take notice that there is a chance that tile does become disfigured in time, wherein, for example, the tile edges may curl upwardly. This could occur when you clean the tile with water or any agents, there are lot of chances to spoil the carpet tiles. Moreover, the known tiles are commonly installed as floated floor covering, without using glue, which may lead to undesired displacement of the tiles with respect to their supporting surface.

It is an object of the invention to provide an improved tile, in particular a carpet tile, to overcome at least one of the drawbacks mentioned above.

SUMMARY OF THE INVENTION

To this end, the invention provides a tile, in particular a carpet tile, comprising: a base, preferably a primary carpet base having pile yarns projecting upwardly therefrom, a backing structure attached to a lower side of said base, preferably said primary carpet base, said backing structure comprising an elastic layer defining a lower surface of the tile, wherein a plurality of (superficial) suction holes is formed in at least a lower surface of said elastic layer allowing the tile to be quickly attached to a support surface and removed therefrom. Preferably, the elastic layer is made from an anisotropic material. Preferably, a plurality of superficial suction holes is formed in at least a lower surface of said elastic layer, wherein the superficial suction holes are open in a direction facing away from the base and substantially closed in a direction facing the base. Typically, the superficial suction holes together define a void footprint (void surface area), wherein material at the lower surface of the elastic layer in between said superficial suction holes define a material footprint (solid surface area). Preferably, the surface area ratio between the void footprint and the material footprint is at least 4, preferably at least 5, more preferably at least 6, thereby allowing the tile to be quickly and relatively firmly attached to a support surface, while easy removal of the tile from said support surface is maintained. A significant advantage of the tile, in particular the carpet tile, according to the invention is that, due to the quick-release adhesive backing structure, the tile is configured to become quickly attached to a support surface in a stable and durable manner, while the tile can also be detached from said support surface in a quick and easy manner without leaving any residue behind. These properties provide the tile, in particular the carpet tile, good dimensional stabilities, good lay flat characteristics, and a flexibility to easily attach and detach the tile to or from a, preferably non-porous and substantially flat, support surface, such as a floor, wall, or even a ceiling. The lower surface of the elastic layer is not provided with any glue, and is preferably free of glue or other chemical adhesives. The adhesive properties of the lower surface of the elastic layer are caused by the presence of small suction holes (microholes, shell-shaped cavities, and/or hemispherical microspaces having a suction effect). During installation a tile to be installed is pushed onto a support surface, which will force air to escape from the suction holes, wherein circumferential edges of the suction holes, and/or elastic material of the lower surface situated in between the suction holes, create a substantially air-tight seal between the lower surface of the elastic layer and the support surface. Upon release of the downward force exerted to the tile installed, a vacuum (sub-atmospheric pressure) will be generated within the suction holes, causing the tile to be pulled towards and held against the support surface. Hence, the tiles will be significantly less susceptible for curling and will become stabilized with respect to the support surface until the suction force is exceeded by exerting an opposite pulling force to the tile e.g. during de-installation. Since no chemical adhesive (glue) is used, the tile according the invention may be efficiently produced in an in-line production method. The tile according to the invention is preferably a carpet tile, wherein the pile yarns can be made from a number of natural or synthetic fibres. Many types of yarn are made differently though, wherein there are typically two main types of yarn: spun and filament. The yarns may be made of nylon but other suitable synthetic yarns such as polyester, polypropylene, acrylic or blends thereof can be employed. The carpet tile may be either rigid or flexible. It is also conceivable that the base is free of any yarn or fibres.

The elastic layer is designed to exhibit a "stiff-adhere, soft-release"-principle, which can be understood in a simple way as follows. When pulled in a stiff direction, less elastic energy can be stored in the material (much like a stiff spring can store less energy compared to a soft spring), leading to lower energy release rate to drive random crack-like flaws induced by support surface roughness. On the other hand, much more elastic energy can be stored in the material when pulled in the soft direction, especially when the material is strongly anisotropic, leading to much higher energy release rate to drive the support surface roughness induced crack-like flaws.

Preferably, the substantially entire lower surface of the elastic layer is provided with suction holes. This will commonly improve and increase that overall suction effect which can be realized during installation of the tile onto a support surface. Although the size of the suction holes may be uniform, wherein the suction holes may for example be stamped, punched and/or mechanically applied into the lower surface of the elastic layer, it is commonly advantageous that the size of the suction holes varies throughout the entire lower surface of the elastic layer, which allows, for example, that the elastic layer is formed by an elastic foam. The elastic foam may have closed cells (cavities) and/or open cells (cavities). In a foam, typically cells with different sizes are present. In one embodiment, the elastic layer is made from a foam material composed of ethylene vinyl acetate (EVA), which is a copolymer of ethylene and vinyl acetate, rubber, polyurethane (PU), polyethylene (PE), polypropylene (PP), polystyrene (PS), (plasticized) polyvinylchloride (PVC), or mixtures thereof. The elastic layer may optionally include other components, such as a filler, such as chalk, talc, sand, fibre, wood, mineral, and/or carbon; a foaming agent, such as azodicarbonamide, a crosslinking agent, such as dicumyl peroxide, a foaming agent, such as zinc oxide; and/or a colouring agent. Preferably, the elastic layer of the tile according to the present invention provides a rubber foam-like material with regard to softness and flexibility. The material has low-temperature toughness, stress-crack resistance, waterproof properties, air-tight sealing properties, and foam recovery after compression.

In a preferred embodiment a number or substantially all of the suction holes have a diameter situated in between 5 μm to approximately 1 mm, preferably in between 10 μm and 500 μm, more preferably between 10 and 300 μm. The density of the elastic layer may vary along the thickness of the elastic layer. For example, the density of the elastic layer may range from about 30 kg/m$^3$ to about 280 kg/m$^3$. In another preferred embodiment, the diameter of the suction holes is between 1 μm and 450 μm, in particular between 2 μm and 400 μm, more in particular between 4 μm and 350 μm. Such distribution ensures an equal distribution of suction holes over the bottom surface of the tiles, with suitably shaped holes for suction, or attachment, onto the subsurface.

Preferably, the elastic layer has a thickness situated in between 0.1 and 10 mm, more preferably between 0.1 and 5 mm. Commonly, this layer thickness is sufficient to realize the desired suction effect during tile installation. Since the elastic layer commonly also exhibits a sound dampening effect, the extent of which depending on the layer thickness, one may prefer to apply an elastic layer with a larger thickness rather than a smaller thickness. Preferably, the thickness of the elastic layer is greater than the largest diameter or radius of the holes so as to ensure that the interior surfaces of the holes are closed by material of the elastic layer.

It is imaginable that a lower surface of the elastic layer is provided with a sealing coating, preferably an air-tight sealing coating, also referred to as a sealant or impermeable coating, in order to improve the suction effect of tile as such. The sealing material can be any suitable sealing material capable of providing a substantially air-tight seal between the suction holes and the support surface. Preferably, the sealing material includes polyurethane ("PU").

In order to protect the suction holes prior to use, in particular during transportation and storage, a removable protective film may initially be attached to the lower surface of the elastic layer. This protective film may be formed by a peel-off liner which is commonly made of paper and/or plastic.

The backing structure of the tile according to the invention preferably comprises a pre-coat layer disposed on the primary carpet base, and at least one, preferably solventless, hot melt adhesive layer disposed on the pre-coat. More preferably, the backing structure comprises a tufted yarn, a primary backing (acting as yarn carrier layer), and at least three polymer-containing layers: a pre-coat layer and at least two solventless layers. The pre-coat layer is preferably made from a hot melt adhesive (HMA) that contains at least approximately 20 weight percent (wt %) of a tackifying resin. In exemplary embodiments the pre-coat layer can contain approximately 2 wt % to approximately 80 wt % polyethylene, and approximately 20 wt % to approximately 98 wt % of the tackifying resin. The tackifying resin itself can include, for example, up to approximately 15 wt % of oils, waxes, and anti-oxidants. The pre-coat layer preferably has a viscosity between approximately 50 centipoise (cps) and approximately 50,000 cps at temperatures between approximately 121 degrees Celsius (° C.), and approximately 221° C. More preferably, the pre-coat layer has a viscosity between approximately 100 cps and approximately 35,000 cps at temperatures between approximately 166° C. and approximately 218° C., and even more preferably a viscosity of approximately 500 cps at approximately 177° C. The pre-coat layer can be roll coated, extruded, or applied using a conventional slot coater. The first extruded polymer layer and the second extruded polymer layer are made from solventless HMA compositions. The HMA compositions can include ethylene-vinyl acetate copolymers (EVA), styrene-isoprene-styrene copolymers (SIS), styrene-butadiene-styrene copolymers (SBS), ethylene-ethyl acrylate copolymers (EEA), ultra-low density polyethylene (ULDPE), low density polyethylene (LDPE), polypropylene, ethylene-propylene diene monomer (EPDM), bitumen, and blends of any of the foregoing (e.g., a blend of polypropylene and EPDM), with EVA being preferred. Either or both of the extruded polymer layers can include a filler. For example, EVA is relatively expensive to use alone, and thus attempts have been made to reduce costs by blending with high levels of relatively cheap extenders, such as fillers. As much as approximately 60 wt % filler may be needed to provide an economically viable composition. As fillers increase viscosity, it is important to use filled HMA compositions with a suitable balance of fluidity and mechanical properties to serve as an adequate polymer layer.

It will be understood by those of skill in the art that references made herein to the general term "hot melt adhesive" or "HMA" compositions will include at times filled HMA (at various ranges), and unfilled HMA; and the disclosed ranges of specifications for such compositions, for example, viscosities, temperatures, and others, will be different for differing filled/unfilled HMA compositions.

For example, if unfilled, the first extruded polymer layer and the second extruded polymer layer of and EVA composition will include approximately 60 wt % to approximately 98 wt % polyethylene and approximately 2 wt % to approximately 40 wt % poly(vinyl-acetate). The copolymer will have a melting point of approximately 60° C. to approximately 232° C., depending on the relative amounts of each component of the copolymer. The unfilled EVA hot melt adhesive also has a viscosity between approximately 250,000 cps and approximately 1,500,000 cps at temperatures between approximately 199° C. and approximately 221° C., and more preferably of approximately 402,000 cps at approximately 210° C.

The first extruded polymer layer and the second extruded polymer layer can also be filled. The blend of polymer (e.g., EVA) to filler is nominally approximately 40 wt % polymer to approximately 60 wt % filler. However, this range can be modified from approximately 10 wt % polymer to approximately 95 wt % polymer, with the filler comprising the remainder of the blend.

The carpet tile may also contain a scrim placed between the first extruded polymer layer and the second extruded polymer layer to provide dimensional stability. The scrim may be a woven layer or a non-woven layer. The scrim is typically made of fibreglass, nylon, polyester, or polypropylene. The carpet tile may also contain a cushioned backing attached to the underside of the second extruded polymer layer to provide suitable cushion characteristics to the carpet tile. Alternatively, in place of the cushioned backing of the base, the elastic layer of the backing structure may also provide desired cushion results to the (carpet) tile. Finally, the carpet tile may contain one or more topical chemical agents applied to the tufted face yarn, such as a stain blocker, a soil release agent, an anti-static agent, an antimicrobial agent, or combinations thereof.

The primary carpet base typically comprises a fibrous face wear surface secured to a primary backing sheet, wherein the primary backing sheet preferably has a fibrous back surface. As already addressed above, the backing structure preferably comprises at least one precoat layer on a lower surface of the primary backing sheet and comprising a hot melt adhesive to aid in securing the fibrous back surface to the primary backing sheet, wherein said hot melt adhesive preferably comprises at least one material selected from the group consisting of: bitumen, petroleum resin composition. The primary carpet base may comprise a secondary backing sheet material to provide dimensional stability to the carpet tile and secured to at least one precoat layer. The primary backing sheet preferably comprises a non-woven sheet, a woven sheet, a non-woven polyester sheet, a polypropylene sheet, a glass fibre scrim or tissue sheet or combinations thereof. Preferably, at least one precoat layer comprises a bitumen hot melt composition containing from about 1% to 15% by weight of an ethylene vinyl ester or an ethylene ester acrylate polymer. Preferably, at least one precoat layer comprises a hot melt bitumen composition which contains about 1% to 10% by weight of an ethylene vinyl acetate polymer. Preferably, at least one precoat layer comprises a hot melt bitumen composition which contains from about 1% to 20% by weight of a rubbery thermoplastic polymer material, preferably a rubbery thermoplastic styrene-diene-styrene block copolymer.

In a preferred embodiment, the backing structure comprises at least one intermediate layer, preferably a substrate layer, situated in between the base and the elastic layer. The intermediate layer may be either rigid or flexible. The intermediate layer preferably comprises at least one material chosen from the group of materials consisting of: wood, in particular MDF or HDF; a polymer, in particular PVC, PE, PP, or PU; mineral, glass, in particular fibreglass, or mixtures thereof. The intermediate layer may further be provided with one or more reinforcement layers, such as a glass fibre layer or polyester layer, to strengthen the panel. The tile may for instance be elongated, and have a width between 10 and 100 cm, and a length of 50 to 250 cm. At least a part of the intermediate layer is preferably made of a—relative environmentally friendly—material comprising plastic material, such as polyethylene (PE), polypropylene (PP), polyethylene terephthalate (PET) or polyurethane (PU), polylactic acid (PLA), polybutylene succinate (PBS), polyester, preferably a compostable polyester, or combinations thereof. The intermediate layer may include filling materials, such as mineral fillers, such as particles, dust, and/or fibres. The tile, in particular the intermediate layer, may further comprise plasticizer to make the panel as such more flexible. The intermediate layer of the panel may at least partially be made of a wood fibre core, for instance a recycled wood fibre core. The intermediate layer may comprise a mixture of recycled plastic and recycled fillers, in particular recycled wood fibres or other recycled fibres of particles.

The thickness of the thickness of the intermediate layer is at least 3 millimetre. Although there is no maximum thickness of the intermediate layer, the layer thickness of this intermediate layer typically varies from 3 to 10 millimetre, more specifically from 3 to 8 millimetre. The intermediate layer can also be considered as substrate layer or as core layer of the tile.

The tile may comprise at least one pair of opposite tile edges, wherein said pair of opposite tile edges is provided with a pair of complementary coupling parts allowing a plurality of such tiles to be connected. Preferably, the complementary coupling parts are configured to couple at least two tiles, such that a locking of the tiles in a first direction, perpendicular to a plane of the tile, and also a locking of the tiles in a second direction, parallel to the plane of the panel, is realized. It is imaginable that at least one pair of complementary coupling parts is configured to be coupled by means of an angling movement, and/or that at least one (other or the same) pair of complementary coupling parts is configured to be coupled by means of a fold-down movement. Preferably, each tile edge is provided with a coupling part, preferably such that opposite tile edges are provided with complementary coupling parts.

The coupling parts preferably make integral part of and/or are attached to the intermediate layer, in particular since the intermediate layer is the most suitable layer to profile and/or to attach coupling parts onto.

At least one of the first coupling parts may comprise an upward tongue, an upward flank lying at a distance from the upward tongue and an upward groove between the upward tongue and the upward flank, and at least one of the second coupling part may comprise a downward tongue, a downward flank lying at a distance from the downward tongue and a downward groove between the downward tongue and the downward flank, wherein the downward tongue may be configured to be pushed into the upward groove for connection. Such arrangement of coupling parts, with upward tongues and downward grooves, is also referred to as a hook-like coupling system. Such system is particularly useful in the push-in locking motions. The upward groove of the first coupling part will generally be given a form such that it is adapted for receiving in locked manner at least a part of a downward tongue of a second coupling part of an adjacent panel. A first locking will thus be formed by confining the downward tongue of a panel in the upward groove of an adjacent panel and by confining the upward tongue of the adjacent panel in the upward groove of the panel.

A side of the upward tongue facing towards the core may be at least partly inclined towards the core or the upward groove and a side of the downward tongue facing towards the core may be at least partly inclined towards the core or the downward groove, wherein the locking portions may be formed by said inclined parts, wherein, in particular, said sides of the tongues and the plane of the panel enclose an angle between 90 and 10 degrees. The inclination of the sides of the tongues towards the respective grooves results in the formation of so-called closed grooves. A closed groove means that the minimal width of the groove is smaller than the maximal width of the tongue, and that deformation of at least one of the coupling parts needs to occur in order to push the tongue into the groove.

Because the coupling parts are given a specific form, the substantially complementarily formed coupling parts of adjacent panels can be coupled to each other relatively simply, but durably and efficiently. During coupling of adjacent panels a force will here be exerted on one or both coupling parts, whereby the one or both coupling parts will deform elastically (move resiliently), as a consequence of which the volume taken up by the downward groove and/or upward groove will be increased such that the upward tongue and the downward tongue can be arranged relatively simply in respectively the downward groove and the upward groove. By subsequently allowing the forced coupling parts to move back resiliently to the original position a reliable, locked coupling will be realized between the two coupling parts, and thereby between the two coupled panels. This locked coupling, wherein both coupling parts mutually engage in relatively reliable manner, will counter friction of parts of the coupling against each other, whereby the coupling as such will generally generate relatively little noise.

The angle between 90 and 10 degrees between the inclined sides and the plane of the panel defines the closed groove of at least one of the coupling parts. The angle of exactly 90 degrees is, at least in this embodiment, not part of the intended range, as this would result in an open groove system.

At least a part of a side of at least one of the upward tongues facing away from the upward flank may be provided with a first locking element, for instance in the form of an outward bulge or a recess, adapted for co-action with a second locking element, for instance in the form of a recess or an outward bulge, of an adjacent panel; and at least a part of a side of at least one of the downward flanks may be provided with a second locking element, for instance in the form of a recess or an outward bulge, adapted for co-action with the first locking element, for instance in the form of an outward bulge or a recess, of an adjacent panel; or vice versa.

The side of the upward tongue facing away from the upward flank may also be considered as the outside of the upward tongue, and may be the side of the upward tongue opposite the inclined side thereof. The locking elements co-act to lock two panels in a coupled and locked condition, and thus contribute to a strong and durable locking. The locking portions of the panel may thus comprise these first and second locking elements. The locking portions of the coupling parts, in this case the first and second locking elements may be provided on all coupling parts, but may also be present on a selection of coupling parts. For instance, one of the first and one of the second coupling parts may be provided with these locking portions, wherein the other coupling parts do not contribute to locking. Alternatively, two of the first and two of the second coupling parts may be provided with these locking portions, or all coupling parts may be provided with these locking portions.

At least a part of the upper side of the upward tongue may be inclined compared to the plane of the panel, and, preferably, the complete upper side of the upward tongue may be inclined. At least a part of the bottom side of the downward groove may also be inclined compared to the plane of the panel, and, preferably, the complete bottom side of the downward groove may be inclined. This has the result that the thickness of the upward tongue decreases in the direction of the side of the tongue facing away from the upward flank. By having the downward groove substantially connect to the upper side of the upward tongue, in a coupled position of two panels according to the invention wherein an upper side of the downward groove extends in the direction of the normal of the lower side of the core, a second coupling part can be provided which is on the one hand relatively strong and solid and can on the other guarantee sufficient resilience to enable a coupling to be realized to a first coupling part of an adjacent floor panel. Additionally, this inclination forms a coupling part with varying thickness, wherein a part of the coupling parts will have a minimal thickness, or thinnest zone. This zone is most prone to elastic deformation, such that during coupling the location of deformation can be determined and set on forehand.

At least one of the first and second coupling parts may further comprise a separate locking element, adapted to co-act with the locking portion to provide locking in at least one of the directions. Such separate locking element is for instance disclosed in EP1415056, which is incorporated by reference with regard to its disclosure on separate locking elements, or snap tab as it is referred to in EP1415056. The separate locking element may be used in both the first and second coupling parts, and is typically arranged to deform at least temporarily during coupling of two panels.

In coupled condition, a gap may exists between the upper side of at least one of the upward tongues and the lower part of at least one of the downward grooves. The presence of a gap between the upper side of the upward tongue and the lower part of the downward groove results in that the upward tongue and the downward groove are, as such, not in direct contact. Instead, the inside and outside of the tongues are on contact. The gap allows foreign material to collect, without hindering the coupling of panels. The gap also allows panel material to collect when such material is for instance shaved of the coupling parts during coupling. Such may occur when, due to for instance production tolerances, one of the coupling parts is slightly over dimensioned compared to the available space.

In coupled condition of a first coupling part and a second coupling part, at least one of the coupling parts may be deformed and/or compressed, which may improve the locking effect realized by these coupling parts. In an alternative embodiment, the mutually coupled coupling parts are coupled in a form-fitting manner, without exerting a (substantial) force onto each other in normal conditions. Preferably, the first coupling part and second coupling parts do not allow play in coupled condition. However, in an alternative embodiment, play, preferably up to 0.2 mm, may be exist between the panels.

On top of the core, the panels may comprise a decorative layer, for instance a decorative print layer, preferably made of plastic and/or paper, or a decorative print printed directly on the core. On top of the decorative layer, a protective layer may be present, to protect the decorative layer. On the bottom of the core a balancing or (sound) dampening layer may be present. In case the decorative layer is a printed layer, preferably a printed polymeric sheet, more preferably a printed PVC layer. On top of the decorative layer, a transparent wear layer, protective layer, and/or lacquer layer may be present, to protect and preserve the decorative layer.

The decorative layer may include, for example, paper. The paper may be a printed melamine impregnated paper, for example, a decor sheet composed of melamine resin impregnated cellulose fibres. The paper may be placed directly on the carrier, for example, an HDF board. The paper may be placed on a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres.

The decorative layer may include, for example, a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres. The decorative layer may include, for example, multiple layers of scattered decorative powder mix.

The decorative layer may include, for example, a wood veneer. The wood veneer may be placed directly on the carrier, for example, an HDF board. The wood veneer may be placed on a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres.

The decorative layer may include, for example, cork. The cork may be placed directly on the carrier, for example, an HDF board. The cork may be placed on a scattering of decorative powder mix. For example, the decorative powder may include wood fibres and a binder, and optionally, a pigment and/or wear resistant particles. The wood fibres of the decorative power may be processed wood fibres or unprocessed wood fibres, such as recycled wood fibres.

The tile according to the invention typically has one of the following shapes: square, rectangular, pentagonal, hexagonal, or octagonal. The tile may also be considered as a panel or as board. The tile according to the invention is typically used as floor tile, in particular a floor panel, wall tile, in particular a wall panel, ceiling tile, in particular a ceiling panel, column tile, and/or beam tile. The tile may also be used to cover objects, such as furniture, with an overlay. The tile according to the invention may have a flat and/or non-flat, in particular angular and/or curved, geometry. The tile as such may be either flexible or rigid. The size of the tile according to the invention may vary strongly, wherein a typical width and length of the tile is situated in between 40 cm and 140 cm. However, it is conceivable that very large tiles are used as carpet covering, wherein the carpet covering may even be formed by a single tile.

The invention also relates to the use of the tile according to the invention as floor tile, in particular a floor panel, wall tile, in particular a wall panel, and/or ceiling tile, in particular a ceiling panel.

The invention further relates to a tile covering consisting of a plurality of tiles according to the invention, which tiles may and/or may not be mutually coupled.

The invention additionally relates to a carpet covering consisting of at least one carpet tile according to the invention.

Preferred embodiments of the floor tile according to the invention are illustrated in the following non-limitative clauses:

Clauses

1. Tile, in particular a carpet tile, comprising:
a base, preferably a primary carpet base having pile yarns projecting upwardly therefrom,
a backing structure attached to a lower side of said base, preferably said primary carpet base, said backing structure comprising an elastic layer defining a lower surface of the tile, wherein a plurality of suction holes is formed in at least a lower surface of said elastic layer allowing the tile to be quickly attached to a support surface and removed therefrom.

2. Tile according to clause 1, wherein the substantially entire lower surface of the elastic layer is provided with suction holes.

3. Tile according to clause 1 or 2, wherein the size of the suction holes varies throughout the entire lower surface of the elastic layer.

4. Tile according to one of the foregoing clauses, wherein the elastic layer is made from a foam material.

5. Tile according to one of the foregoing clauses, wherein the elastic layer comprises a foaming agent.

6. Tile according to one of the foregoing clauses, wherein the elastic layer is at least partially composed of at least one material selected from the group consisting of: ethylene vinyl acetate (EVA), polyurethane (PU), polyethylene (PE), polypropylene (PP), polystyrene (PS), poly vinyl chloride (PVC), rubber, or mixtures thereof.

7. Tile according to one of the foregoing clauses, wherein the elastic layer comprises at least one cross-linking agent.

8. Tile according to one of the foregoing clauses, wherein the elastic layer comprises a filler, in particular, talc, chalk, wood, and/or calcium carbonate.

9. Tile according to one of the foregoing clauses, wherein a number or substantially all of the suction holes have a diameter situated in between 5 μm to approximately 1 mm, preferably in between 10 μm and 500 μm.

10. Tile according to one of the foregoing clauses, wherein the density of the elastic layer varies along the thickness of the elastic layer.

11. Tile according to one of the foregoing clauses, wherein the elastic layer has a thickness situated in between 0.1 and 6 mm.

12. Tile according to one of the foregoing clauses, wherein each of the suction holes, and preferably the entire lower surface of the elastic layer, is free of glue.

13. Tile according to one of the foregoing clauses, wherein the lower surface of the elastic layer has a sealing effect, preferably an air-tight sealing effect.

14. Tile according to one of the foregoing clauses, wherein a lower surface of the elastic layer is provided with a sealing coating, preferably an air-tight sealing coating.

15. Tile according to one of the foregoing clauses, wherein initially, before use, a removable protective film is attached to the lower surface of the elastic layer.

16. Tile according to one of the foregoing clauses, wherein the backing structure comprises a pre-coat layer disposed on the primary carpet base, and at least one, preferably solventless, hot melt adhesive layer disposed on the pre-coat.

17. Tile according to clause 16, wherein the pre-coat layer comprises a tackifying resin.

18. Tile according to one of the foregoing clauses, wherein the tile comprises a thermoplastic material securing said primary carpet base to said backing structure, wherein said thermoplastic material is preferably provided with at least one stabilizing material embedded therein.

19. Tile according to one of the foregoing clauses, wherein the primary carpet base comprises a fibrous face wear surface secured to a primary backing sheet, wherein the primary backing sheet preferably has a fibrous back surface.

20. Tile according to clause 19, wherein the backing structure comprises at least one precoat layer on a lower surface of the primary backing sheet and comprising a hot melt adhesive to aid in securing the fibrous back surface to the primary backing sheet, wherein said hot melt adhesive preferably comprises at least one material selected from the group consisting of: bitumen, petroleum resin composition.

21. Tile according to one of clauses 19-20, wherein the primary carpet base comprises a secondary backing sheet material to provide dimensional stability to the carpet tile and secured to at least one precoat layer.

22. Tile according to one of clauses 19-21, wherein the primary backing sheet comprises a non-woven sheet, a woven sheet, a non-woven polyester sheet, a polypropylene sheet, a glass fibre scrim or tissue sheet or combinations thereof.

23. Tile according to one of clauses 19-22, wherein at least one precoat layer comprises a bitumen hot melt composition containing from about 1% to 15% by weight of an ethylene vinyl ester or an ethylene ester acrylate polymer.

24. Tile according to one of clauses 19-23, wherein at least one precoat layer comprises a hot melt bitumen composition which contains about 1% to 10% by weight of an ethylene vinyl acetate polymer.

25. Tile according to one of clauses 19-24, wherein at least one precoat layer comprises a hot melt bitumen composition which contains from about 1% to 20% by weight of a rubbery thermoplastic polymer material, preferably a rubbery thermoplastic styrene-diene-styrene block copolymer.

26. Tile according to one of the foregoing clauses, wherein the backing structure comprises at least one intermediate layer, preferably a substrate layer, situated in between the base and the elastic layer.

27. Tile according to clause 26, wherein the intermediate layer either rigid or flexible, and wherein said intermediate layer comprises at least one material of the group of materials consisting of: wood, in particular MDF or HDF; a polymer, in particular PVC, PE, PP, or PU; mineral, or mixtures thereof.

28. Tile according to clause 26 or 27, wherein the thickness of the intermediate layer is at least 3 millimetre.

29. Tile according to one of the foregoing clauses, wherein the tile comprises at least one pair of opposite tile edges, wherein said pair of opposite tile edges is provided with a pair of complementary coupling parts allowing a plurality of such tiles to be connected.

30. Tile according to clause 29, wherein the complementary coupling parts are configured to couple at least two tiles, such that a locking of the tiles in a first direction, perpendicular to a plane of the tile, and also a locking of the tiles in a second direction, parallel to the plane of the panel, is realized.

31. Tile according to clause 29 or 30, wherein at least one pair of complementary coupling parts is configured to be coupled by means of an angling movement.

32. Tile according to one of clauses 29-31, wherein at least one pair of complementary coupling parts is configured to be coupled by means of a fold-down movement.

33. Tile according to one of clauses 29-32, wherein each tile edge is provided with a coupling part, preferably such that opposite tile edges are provided with complementary coupling parts.

34. Tile according to one of clauses 26-28 and one of clauses 29-33, wherein the coupling parts make integral part of and/or are attached to the intermediate layer.

35. Tile according to one of the foregoing clauses, wherein the base comprises a decorative layer and a transparent wear layer covering said decorative layer.

36. Tile according to clause 35, wherein the decorative layer is a printed layer, preferably a printed polymeric sheet, more preferably a printed PVC layer.

37. Tile according to one of the foregoing clauses, wherein the tile has one of the following shapes: square, rectangular, pentagonal, hexagonal, octagonal.

38. Tile according to one of the foregoing clauses, wherein the superficial suction holes are substantially hemispherically shaped.

39. Tile according to one of the foregoing clauses, wherein elastic layer material defining said superficial suction holes is provided with an impermeable coating.

40. Tile according to one of the foregoing clauses, wherein elastic layer material comprises a plurality of interconnected, open cells.

41. Use a tile according to one of clauses 1-40 as floor tile, in particular a floor panel, wall tile, in particular a wall panel, and/or ceiling tile, in particular a ceiling panel.

42. Tile covering consisting of a plurality of tiles according to one of the clauses 1-40.

43. Tile covering according to clause 42, wherein the tiles are mutually coupled.

44. Carpet covering consisting of at least one carpet tile according to one of clauses 1-40.

BRIEF DESCRIPTION OF THE DRAWINGS

The invention will be elucidated on the basis of non-limitative exemplary embodiments shown in the following figures. Herein.

DESCRIPTION OF THE INVENTION

Figure 1:
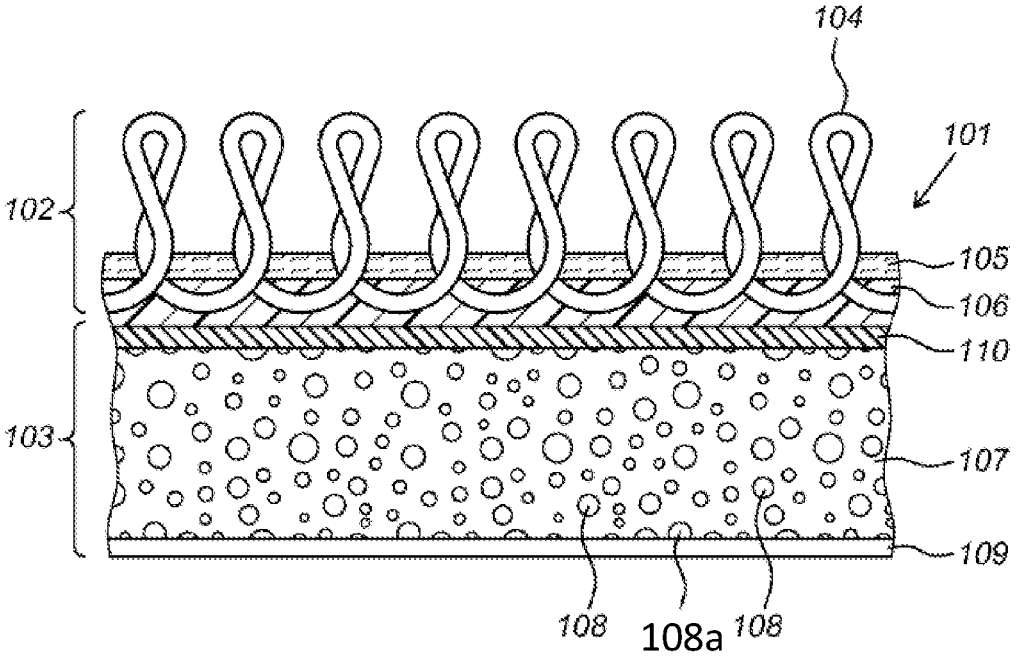
FIG. 1 shows a cross-sectional view of a first possible embodiment of a tile according to the invention.

FIG. 1 shows a tile (101), in particular a carpet tile (101), comprising a base (102) and a backing structure (103) attached to a lower side of said base (102). The base (102) of the shown embodiment is a primary carpet base (102) having pile yarns (104) projecting upwardly therefrom. The pile yarns (104) shown consist of loop piles (104). It is however also possible that the pile yarns (104) consist of cut piles, twisted piles or any other suitable pile yarns in for example a level- or multilevel configuration. The loop piles (104) are possibly synthetic yarns, such as nylon, polyester, polypropylene, acrylic or blends thereof. In the shown embodiment, the loop piles (104) are tufted in the primary carpet base (102). The primary carpet base (102) comprises a primary backing sheet (105), which can for example be a non-woven sheet, a woven sheet, a non-woven polyester sheet, a polypropylene sheet, a glass fibre scrim or tissue sheet or combinations thereof. To bond the tufts in position on the base (102), and in particular on the primary backing sheet (105), a pre-coat layer (106) is applied. This pre-coat layer (106) can for example be a latex layer (106). This pre-coat layer (106) can possibly form part of the backing structure (103). The backing structure (103) comprises an elastic layer (107). The elastic layer (107) defines a lower surface of the tile (101). The elastic layer (107) comprises a plurality of suction holes (108), which are merely schematically shown in the figures. The suction holes (108) can have air or a gas trapped inside. The suction holes (108) provided at the lower surface of the elastic layer (107) are referred to as superficial suction holes (108*a*), which enable the elastic layer (107) to be quickly attached to a support surface (not shown) and removed therefrom. In the shown embodiment is the entire elastic layer (107) provided with suction holes (108) in a random configuration. It is also possible that the elastic layer (107) comprises suction holes (108) forming a uniform pattern. It is however also possible that only a lower surface of the elastic layer (107) is provided with suction holes (108). The size of the suction holes (108) varies in the shown embodiment throughout the entire elastic layer (107). The diameter size of a number of suction holes (108) is for example situated between 5 μm to approximately 1 mm. The diameter of a number of suction holes (108) is for example in between 10 μm and 500 μm. The elastic layer (107) has for example a thickness situated between 0.1 and 6 mm. The elastic layer (107) may have a uniform density, however it is also possible that the density of the elastic layer varies along the thickness of the elastic layer (107). In the shown embodiment is the elastic layer (107) made of a foam material and/or comprise a foaming agent. The lower surface of the elastic layer (107) has an air-tight sealing effect. The tile (101) comprises, in the shown embodiment, a removable protective film (109) which is attached to the lower surface of the elastic layer (107). The protective film (109) is for example a peel-off layer (109) and is removed before or during use of the tile (101) such that the suction holes (108) are exposed. The backing structure (103) furthermore comprises an adhesive layer (110). This adhesive layer (110) is for example a solventless, hot melt adhesive layer (110) disposed on the pre-coat layer (106). Such hot melt adhesive (110) preferably comprises at least one material selected from the group consisting of: bitumen, petroleum resin composition. Preferably, the surface area ratio between the void footprint defined by the (empty surface area of the) superficial suction holes 108*a*, and the material footprint defined by the (non-empty) material fraction at the lower surface of the elastic layer (107) is at least 4, preferably at least 5, more preferably at least 6, thereby allowing the tile to be quickly and relatively firmly attached to a support surface, while easy removal of the tile from said support surface is maintained.

Figure 2:
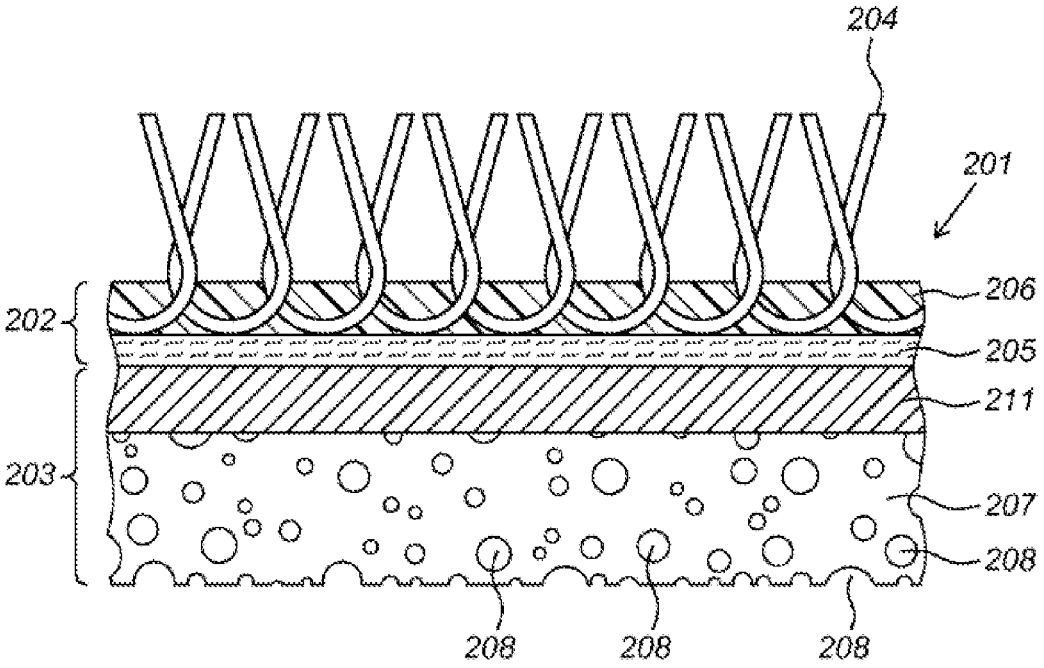
FIG. 2 shows a cross-sectional view of a second possible embodiment of a tile according to the invention.

FIG. 2 shows a tile (201), in particular a carpet tile (201), comprising a base (202) or primary carpet base (202) having pile yarns (204) projecting upwardly therefrom. The carpet tile (201) furthermore comprises a backing structure (203) attached to a lower side of said primary carpet base (202). The backing structure (203) comprises an elastic layer (207) defining a lower surface of the tile (201), wherein a plurality of suction holes (208) is formed allowing the tile to be quickly attached to a support surface (not shown) and removed therefrom. The suction holes (208) are randomly positioned and the size of the suction holes (208) varies throughout the entire lower surface of the elastic layer (207). The elastic layer (207) is made from a foam material, and can possibly comprise a foaming agent. Non-limited examples of the materials whereof the elastic layer (207) can be composed are ethylene vinyl acetate (EVA), polyurethane (PU), polyethylene (PE), polypropylene (PP), polystyrene (PS), poly vinyl chloride (PVC), rubber, or mixtures thereof. The elastic layer (207) may furthermore comprises a cross-linking agent and/or a filler, such as talc, chalk, wood, and/or calcium carbonate. Each of the suction holes (208) can however be free of glue. The pile yarns (204) shown in this embodiment consist of cut pile yarns (204). The cut pile yarns (204) can for example comprise nylon or other suitable material implemented in a PVC or hot-melt adhesive (206) which is laminated to a primary backing sheet (205), which can also be referred to as reinforcement layer (205). The primary backing sheet (205) comprises for example a woven or non-woven material. The hot melt adhesive (206) can for example comprise a bitumen and/or petroleum resin composition. The primary carpet base (202) can possibly furthermore comprise a fibrous face wear surface secured to the primary backing sheet (205), wherein the primary backing sheet (205) preferably has a fibrous back surface. The backing structure (203) comprises furthermore an intermediate layer (211), situated in between the base (202) and the elastic layer (203). The intermediate layer (211) is either rigid or flexible, and comprises at least one material of the group of materials consisting of: wood, in particular MDF or HDF; a polymer, in particular PVC, PE, PP, or PU; mineral, or mixtures thereof. The tile (201) can also possibly comprise a protective layer (not shown), for example as shown in FIG. 1.

Figure 3:
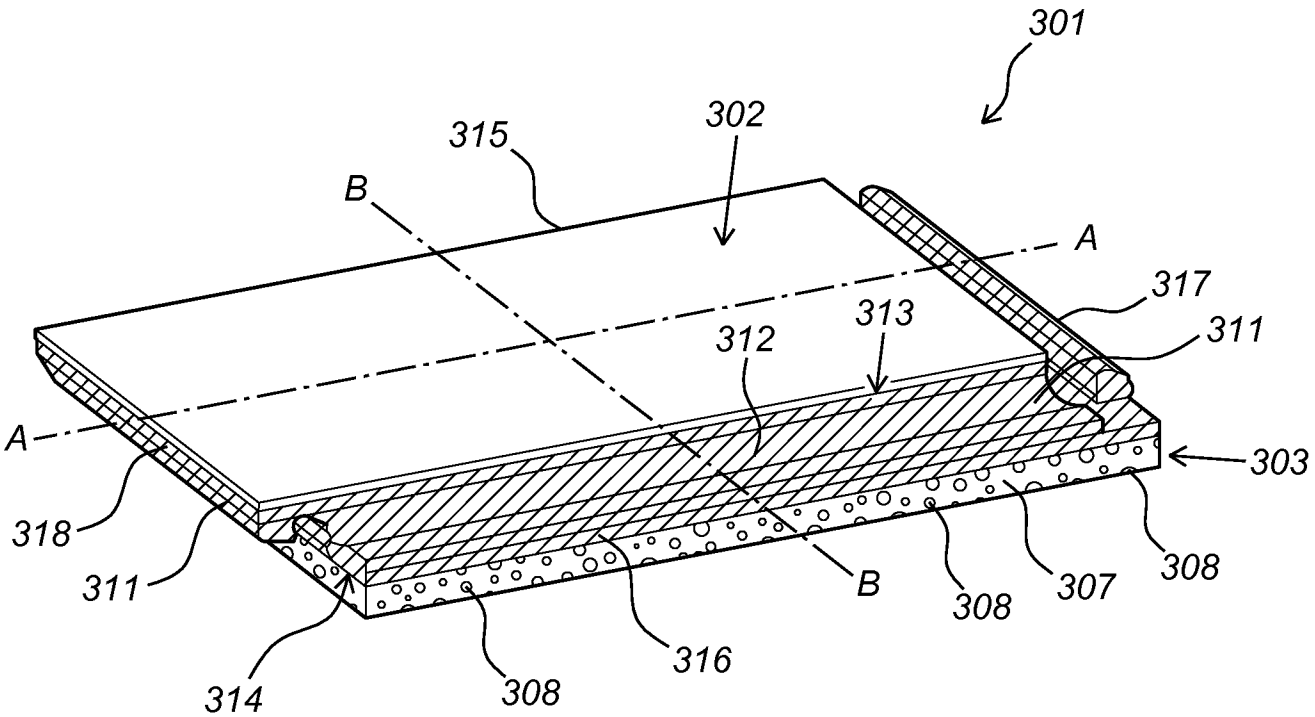
FIG. 3 shows a third possible embodiment of a tile according to the invention.

FIG. 3 shows a tile (301), in particular a panel (301), more in particular a floor panel (301) or wall panel (301) according to the invention. The tile (301) is interconnectable with similar tiles (301) for forming a floor covering. The tile (301) comprises a base (302) and a backing structure (303) attached to a lower side of said base (302). The backing structure (303) comprises an elastic layer (307) defining a lower surface of the tile (301), wherein a plurality of suction holes (308) is formed in said elastic layer (307) allowing the tile (301) to be quickly attached to a support surface (not shown) and removed therefrom. Furthermore, the tile (301), and in particular the backing structure (303), comprises an intermediate layer (311), preferably a substrate layer (311), situated in between the base (302) and the elastic layer (303). The intermediate layer (311) is either rigid or flexible, and comprises at least one material of the group of materials consisting of: wood, in particular MDF or HDF; a polymer, in particular PVC, PE, PP, or PU; mineral, or mixtures thereof. The thickness of the intermediate layer (311) is for example at least 3 millimetre. The base (302) may comprise a top structure comprising a decorative layer, which may be printed onto the base layer, on top of which a protective layer may be applied. The base (302) can for example be a primary carpet base having pile yarns projecting upwardly therefrom, for example as shown in FIGS. 1 and 2. The intermediate layer (311) comprises a centrally located core (312) provided with an upper side (313) and a lower side (314). The core (312) is integrally connected with a first pair of opposite edges, in particular a first edge (315) and a complementary second edge (316), located at the long lateral sides of the tile (301). The core (312) is also integrally connected with a second pair of opposite edges, in particular a third edge (317) and a complementary fourth edge (318), located at the short sides of the tile (301) in this exemplary embodiment. A benefit of the presence of the intermediate layer (311) as shown in FIG. 3 is that mutual locking of adjacent tiles (301) is enabled. Locking of adjacent tiles (301) in a first direction, perpendicular to a plane of the tile (301), and also a locking of the tiles (301) in a second direction, parallel to the plane of the tile (301), can herewith be realized. Furthermore, the change of curling or disfiguring of tiles (301) is reduced. The shown tile (301) has a rectangular shape. It is, however also possible that the tile (301) comprises a square, pentagonal, hexagonal or octagonal shape. The tile (301) may possibly comprise a protective film such as a peel-off layer (not shown), which can be removed before or during use of the tile (301) such that the suction holes (308) are exposed. An example of such protective film is shown in FIG. 1.

Figure 4:
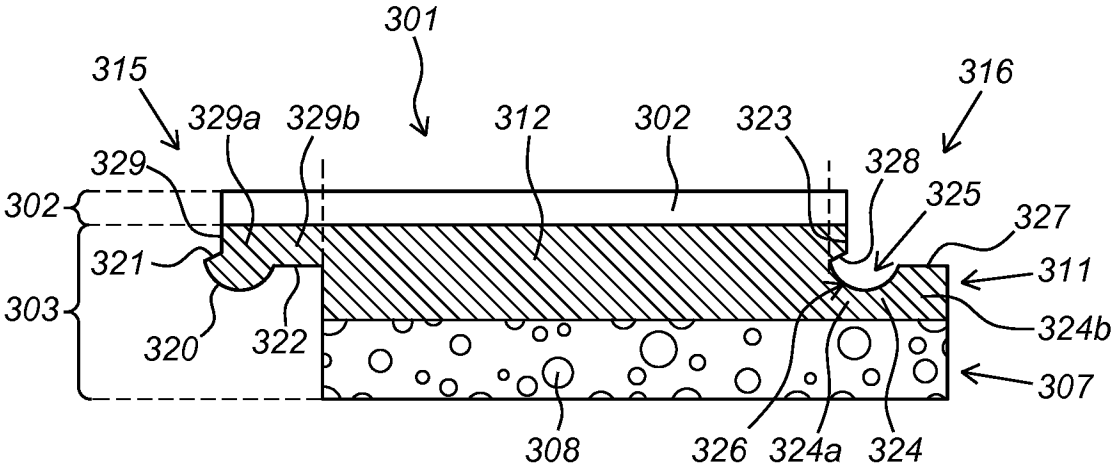
FIG. 4 is a cross-sectional view indicated by section A-A in FIG. 3.

FIG. 4 is a cross-sectional view indicated by section A-A in FIG. 3. In this cross-section, the shape of the complementary first edge (315) and second (316) edge are shown in detail. The first edge (315) comprises a sideward tongue (329) which is integrally connected to the core (312). By means of the vertical dashed line the border between the sideward tongue (329) and the core (312) is visualised. A front region (329A) of the sideward tongue (329) is provided with a rounded bottom surface (320). An outer end of the rounded bottom surface (320) adjoins an inclined locking surface (321). An opposite end of the rounded bottom surface (320) adjoins a bearing surface (322) making part of a back region (329B) of the sideward tongue (329). The second edge (316) of the intermediate layer (311) comprises an upper lip (323) and a lower lip (324) defining a recess (325). Both lips (323, 324) are integrally connected to the core (312). By means of the vertical dashed line the border between the lips (323, 324) and the core (312) is visualised. As shown in FIG. 3, the width of the upper lip (323) is substantially smaller than the width of the lower lip (324). The recess (325) has a shape which is complementary to the shape of the sideward tongue (329). More in particular, a top surface (326) of a back region (324*a*) of the lower lip (324) has a (complementary) rounded shape, configured to co-act with the rounded front region (329*a*) of the sideward tongue (329), while a front region (324*b*) of the lower lip (324) is provided with a upwardly protruding shoulder (327), configured to co-act with the bearing surface (322) of the sideward tongue (329). A lower surface (328) of the upper lip (323) is inclined and corresponds to the locking surface (321) of the sideward tongue (329). Locking at the first edge (315) and the second edge (316) of adjacent tiles (301) by insertion of the sideward tongue (329) of a tile (301) to be coupled into the recess (325), wherein said tile (301) is initially held in an inclined position. After insertion of the sideward tongue (329) into the recess, the tile (301) to be coupled will be pivoted (angled) in downward direction about an axis parallel to the first edge (315) until both tiles (301) are positioned in the same—commonly horizontal—plane, wherein the locking surface (321) of the sideward tongue (329) will engage the locking surface of the upper lip (328), and wherein at least a bottom front part is accommodated substantially form-fittingly in the recess (325), and wherein the bearing surface (322) is supported by the shoulder (327). Locking at the first edge (315) and the second edge (316) leads to locking of the connected tiles (301) in both horizontal direction and vertical direction. The angling down locking principle of the first and second edges (315, 316) is a relatively easy locking principle which facilitates mutual coupling of tiles at these edges (315, 316) tremendously.

Figure 5:
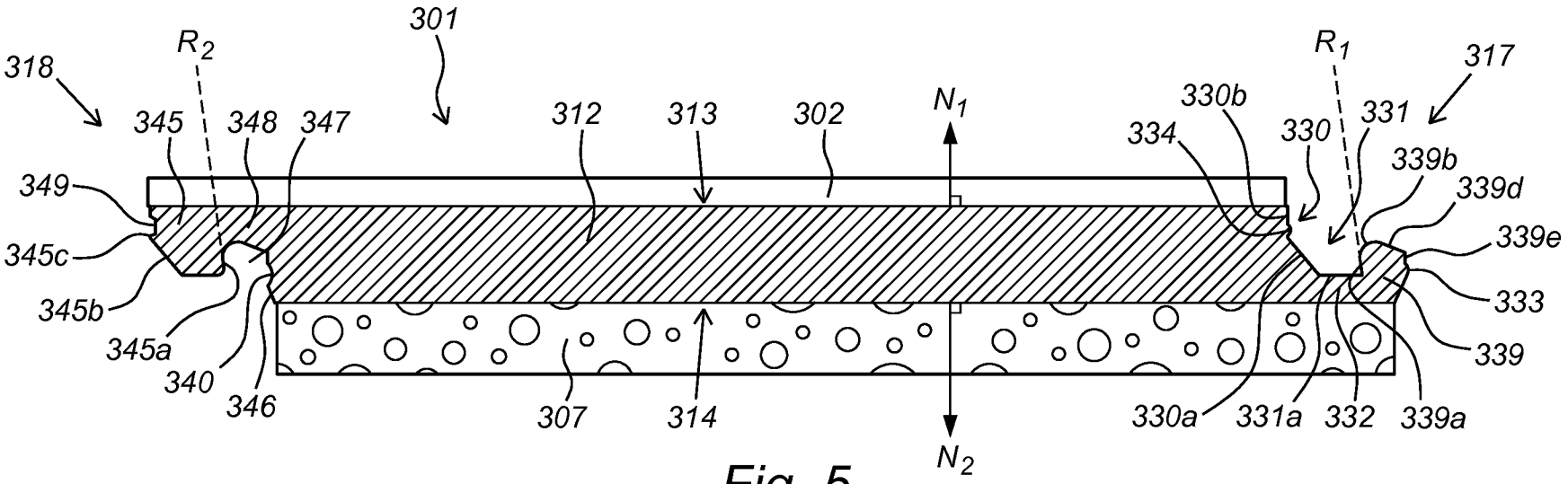
FIG. 5 is a cross-sectional view indicated by section B-B in FIG. 3.

FIG. 5 is a cross-sectional view indicated by section B-B in FIG. 3. In this cross-section, the shape of the complementary third edge (317) and second (318) edge are shown in detail. The third edge (317) comprises an upward tongue (339), an upward flank (330) and an upward groove (331) formed between upward tongue (339) and upward flank (330). The upward tongue (339) is connected to the core (312) by means of a bridge (332), which is preferably resilient to some extent. A side (339*a*) of upward tongue (339) facing toward upward flank (330) extends in the direction of the normal N1 of the upper side (313) of the core (312). The tangent R1 and the normal N1 of the upper side (313) of the core (312) are thus directed toward each other (converging orientation), wherein the angle enclosed by R1 and N1 is preferably between 0 and 10 degrees in this exemplary embodiment. Due to the converging orientation of the upward flank (330) and the side (339*a*) of the upward tongue (339) facing toward to the upward flank (330), the upward groove is a closed groove, which is only accessible to a complementary counterpart by deformation of the upward tongue (339) and/or bridge (332). Another side (339*b*) of upward tongue (339) facing toward upward flank (330) forms an aligning edge enabling facilitated realization of a coupling to an adjacent tile (301). As shown, this side (339*b*) functioning as aligning edge is directed away from the normal N1 of upper side (313) of the core (312). An upper side (339*d* of upward tongue (339) does however extend in the direction of the normal N1 of the upper side (313) of the core (312), and runs inclining downward in the direction of the side (339*e*) of upward tongue (339) facing away from upward flank (330). This chamfering provides the option of giving the complementary fourth edge (318) a more robust and therefore stronger form. A part of the side (339*e*) of upward tongue (339) facing away from upward flank (330) is oriented substantially vertically and is moreover provided with an outward bulge (333). A lower part (330*a*) of upward flank (330) is oriented diagonally, while an upper part (330*b*) of upward flank (330) is shown to be substantially vertical and forms a stop surface for fourth edge (318). In between the inclined part (330*a*) and the substantially vertical part (330*b*) of the upward flank an additional coupling element, in particular an additional bulge (334), is provided. A lower wall part (331*a*) of upward groove (331) is oriented substantially horizontally in this exemplary embodiment. The fourth edge (318) is substantially complementary to third edge (317). The fourth edge (318) comprises a downward tongue (345), a downward flank (346) and a downward groove (347) formed in between downward tongue (345) and downward flank (346). The downward tongue (345) is connected to the core (312) by means of a bridge (348), which is preferably resilient to some extent. A side (345*a*) of downward tongue (345) facing toward downward flank (346) lies in the direction of the normal N2 of the lower side (314) of the core (312). This means that a tangent R2 of side (345*a*) of downward tongue (345) and the normal of the lower side (314) of the core (312) are mutually converging, wherein the angle enclosed by R2 and N2 is preferably between 0 and 10 degrees in this exemplary embodiment. More preferably, the inclination of R1 is identical to the inclination of R2; hence, R1 and R2 are preferably parallel. Due to the converging orientation of the downward flank (346) and the side (345*a*) of the downward tongue (345) facing toward to the downward flank (346), the downward groove (347) is a closed groove, which is only accessible for the upward tongue (339) of an adjacent tile (301) by deformation of the downward tongue (345) and/or bridge (348), as a result of which the entrance of the downward groove can be widened (temporary). A side (345*b*) of the downward tongue (345) facing away from downward flank (346) is diagonally oriented, but has a flatter orientation than the complementary side (330*a*) of upward flank (330), whereby a gap (air space) will be formed in the coupled position, which will generally facilitate coupling between two tiles (301). The inclining side (345*b*) of downward tongue (345) also functions as aligning edge for the purpose of further facilitating coupling between two tiles (301). Another side (345*c*) facing away from downward flank (346) takes a substantially vertical form, though is provided with a small cavity (349) configured to co-act with the additional bulge (334) of another tile (301). A top part of the side (345*c*) facing away from downward flank (346) forms a complementary stop surface for stop surface (330*b*) of upward flank (330) (of an adjacent tile). Downward flank (346) is oriented substantially vertically and is provided with a recess (340) adapted to receive the outward bulge (333) of the upward tongue (339) (of an adjacent tile).

The above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

The invention claimed is:

1. A tile, comprising:

a base having pile yarns projecting upwardly therefrom, a backing structure attached to a lower side of said base, said backing structure comprising an elastic layer, made from an anisotropic material, defining a lower surface of the tile, wherein a plurality of superficial suction holes is formed in at least a lower surface of said elastic layer, wherein the plurality of superficial suction holes are open in a direction facing away from the base and substantially closed in a direction facing the base, wherein the plurality of superficial suction holes together define a void footprint, wherein material at the lower surface of the elastic layer in between said plurality of superficial suction holes define a material footprint, wherein a ratio of the void footprint to the material footprint is at least 4, thereby allowing the tile to be attached to a support surface and removed therefrom, wherein the lower surface of the elastic layer is provided with a sealing coating.

2. The tile according to claim 1, wherein the substantially entire lower surface of the elastic layer is provided with suction holes.

3. The tile according to claim 1, wherein the size of the suction holes varies throughout the entire lower surface of the elastic layer.

4. The tile according to claim 1, wherein the elastic layer is made from a foam material.

5. The tile according to claim 1, wherein the elastic layer comprises a foaming agent.

6. The tile according to claim 1, wherein the elastic layer is at least partially composed of at least one material selected from the group consisting of: ethylene vinyl acetate (EVA), polyurethane (PU), polyethylene (PE), polypropylene (PP), polystyrene (PS), poly vinyl chloride (PVC), rubber, or mixtures thereof.

7. The tile according to claim 1, wherein the elastic layer comprises at least one cross-linking agent.

8. The tile according to claim 1, wherein the elastic layer comprises a filler.

9. The tile according to claim 1, wherein a number or substantially all of the plurality of superficial suction holes have a diameter situated in between 5 μm to approximately 1 mm.

10. The tile according to claim 1, wherein the density of the elastic layer varies along the thickness of the elastic layer.

11. The tile according to claim 1, wherein the elastic layer has a thickness situated in between 0.1 and 6 mm.

12. The tile according to claim 1, wherein each of the plurality of superficial suction holes, and the entire lower surface of the elastic layer, is free of glue.

13. The tile according to claim 1, wherein the lower surface of the elastic layer has a sealing effect.

14. The tile according to claim 1, wherein initially, before use, a removable protective film is attached to the lower surface of the elastic layer.

15. The tile according to claim 1, wherein the backing structure comprises a pre-coat layer disposed on a primary carpet base, and at least one hot melt adhesive layer disposed on the pre-coat.

16. The tile according to claim 1, wherein the tile comprises a thermoplastic material securing a primary carpet base to said backing structure, wherein said thermoplastic material is provided with at least one stabilizing material embedded therein.

17. The tile according to claim 1, wherein a primary carpet base comprises a fibrous face wear surface secured to a primary backing sheet, wherein the primary backing sheet has a fibrous back surface.

18. The tile according to claim 1, wherein the backing structure comprises at least one intermediate layer situated in between the base and the elastic layer, wherein the intermediate layer either rigid or flexible, and wherein said intermediate layer comprises at least one material of a group of materials consisting of: wood; a polymer; mineral, or mixtures thereof.

19. The tile according to claim 1, wherein the tile comprises at least one pair of opposite tile edges, wherein said pair of opposite tile edges is provided with a pair of complementary coupling parts allowing a plurality of such tiles to be connected.

20. The tile according to claim 19, wherein the complementary coupling parts are configured to couple at least two tiles, such that a locking of the tiles in a first direction, perpendicular to a plane of the tile, and also a locking of the tiles in a second direction, parallel to the plane of the tile, is realized.

21. The tile according to claim 1, wherein the base comprises a decorative layer and a transparent wear layer covering said decorative layer.

22. The tile according to claim 1, wherein the superficial suction holes are substantially hemispherically shaped.

23. The tile according to claim 1, wherein elastic layer material defining said superficial suction holes is provided with an impermeable coating.

24. The tile according to claim 1, wherein elastic layer material comprises a plurality of interconnected, open cells.

25. A tile covering consisting of a plurality of tiles according to claim 1.

26. The tile covering according to claim 25, wherein the tiles are mutually coupled.

* * * * *